US005372026A

United States Patent [19]

Roper

[11] Patent Number: 5,372,026

[45] Date of Patent: Dec. 13, 1994

[54] APPARATUS AND METHOD FOR HYDROFORMING SHEET METAL

[75] Inventor: Ralph E. Roper, Indianapolis, Ind.

[73] Assignees: Armco Steel Company, Middletown, Ohio; L.P. & Price Enterprises, Ltd., Madison Heights, Mich.

[21] Appl. No.: 855,815

[22] Filed: Mar. 23, 1992

Related U.S. Application Data

[63] Continuation-in-part of Ser. No. 443,112, Nov. 29, 1989, Pat. No. 5,157,969.

[51] Int. Cl.[5] ..... B21D 26/02

[52] U.S. Cl. ..... 72/60; 72/350; 72/453.04; 29/421.1

[58] Field of Search ..... 72/56, 57, 60, 63, 296, 72/297, 453.03, 453.04, 350; 29/421.1

[56] References Cited

U.S. PATENT DOCUMENTS

| | | |
|---|---|---|
| 393,081 | 5/1888 | Swift . |
| 906,911 | 12/1908 | McCullough . |
| 1,180,738 | 4/1916 | Rehbein . |
| 1,180,739 | 4/1916 | Rehbein . |
| 1,625,914 | 4/1927 | Seibt . |
| 2,292,462 | 8/1942 | Milford . |
| 2,317,869 | 4/1943 | Walton . |
| 2,344,743 | 3/1944 | Smith, Jr. . |
| 2,649,067 | 8/1953 | Kranenberg . |
| 2,726,973 | 12/1955 | Corral . |
| 2,771,851 | 11/1956 | McGregor . |
| 2,821,156 | 1/1958 | Lyon . |
| 3,020,633 | 2/1962 | Heuer . |
| 3,208,255 | 9/1965 | Bürk . |
| 3,222,910 | 12/1965 | Roper . |
| 3,241,348 | 3/1966 | Roper . |
| 3,254,521 | 6/1966 | Roper . |
| 3,264,730 | 8/1966 | Roper . |
| 3,285,045 | 11/1966 | Berg . |
| 3,286,496 | 11/1966 | Burk . |
| 3,286,570 | 11/1966 | Roper . |
| 3,299,689 | 5/1964 | Dolney et al. . |
| 3,314,270 | 4/1967 | Dolney . |
| 3,373,585 | 3/1968 | Reynolds . |
| 3,392,561 | 7/1968 | Feather . |

(List continued on next page.)

FOREIGN PATENT DOCUMENTS

| | | | |
|---|---|---|---|
| 278062 | 2/1987 | European Pat. Off. . | |
| 2345985 | 3/1975 | Germany . | |
| 2450624 | 5/1975 | Germany . | |
| 50-35026 | 11/1975 | Japan . | |
| 57-72730 | 5/1982 | Japan . | |
| 0166127 | 8/1985 | Japan | 72/60 |
| 61-238423 | 10/1986 | Japan . | |
| 619254 | 8/1978 | U.S.S.R. . | |
| 1021513 | 6/1983 | U.S.S.R. | 72/60 |
| 1263392 | 10/1986 | U.S.S.R. . | |

OTHER PUBLICATIONS

Roper, Ralph E. "Progressive Dies with Stretch Forming" (1986).

(List continued on next page.)

*Primary Examiner*—David Jones

*Attorney, Agent, or Firm*—Larry A. Fillnow; Robert J. Bunyard; Robert H. Johnson

[57] ABSTRACT

A self-contained apparatus for forming metal sheet is adapted for operation within a standard double action press having a base and outer and inner vertically reciprocating slides and includes a basic die mountable to the press and specific tooling replaceably mountable to the basic die. The basic die includes an upper shoe mountable to the outer slide, a reservoir pan mounted atop the base, and hydraulic cylinder assemblies mounted with the pan and mechanically actuatable by the inner slide for providing pressurized fluid to the specific tooling. The specific tooling includes mating upper and lower dies connected to the upper shoe and base, respectively, and movable between open and closed positions. A sheet metal blank positioned upon the lower die is wrapped around the lower die as the upper die is moved down to a closed position by the outer slide, the blank being clamped between the upper and lower dies whereby the periphery of the blank is securely gripped by gripper steels mounted all around a part print cavity in the upper die. The outer slide then dwells while the inner slide moves down, engaging and actuating the cylinder assemblies, causing hydraulic fluid to be forced into a region between the clamped blank and the lower die, the blank being 100% stretch formed into the part print cavity defined in the upper die.

13 Claims, 12 Drawing Sheets

U.S. PATENT DOCUMENTS 3,396,561 8/1968 Day .
3,440,711 4/1969 Roper .
3,443,413 5/1969 Roper .
3,516,274 6/1970 Graham et al. .
3,530,272 9/1970 Roper .
3,568,487 3/1971 Riesener .
3,585,828 6/1971 Roper .
3,596,485 8/1971 Burk .
3,623,347 11/1971 Burk .
3,646,653 3/1972 Richard .
3,664,172 5/1972 Cvacho .
3,686,910 8/1972 Fuchs, Jr. .
3,686,921 8/1972 Roper .
3,715,902 2/1973 Fuchs, Jr. .
3,751,956 8/1973 Blanchi .
3,769,824 11/1973 Granzow .
3,789,649 2/1974 Clowes .
3,890,819 6/1975 DeLuca .
3,914,969 10/1975 Banks .
3,934,440 1/1976 Berg .
3,934,441 1/1976 Hamilton et al. .
3,962,895 6/1976 Rydell .
4,062,215 12/1977 Roper .
4,195,510 4/1980 Juergens .
4,211,102 7/1980 Hurvitz .
4,238,949 12/1980 Roper .
4,265,102 5/1981 Shimakata et al. .
4,295,357 10/1981 Roper .
4,314,468 2/1982 Baril et al. .
4,352,280 10/1982 Ghosh .
4,409,808 10/1983 Festag et al. .
4,419,876 12/1983 Spacek et al. .
4,432,222 2/1984 Ujihara et al. .
4,472,955 9/1984 Nakamura et al. .
4,502,309 3/1985 Hamilton et al. .
4,576,030 3/1986 Roper .
4,689,979 9/1987 Otsuka et al. .
4,748,837 6/1988 Kurosawa et al. .
4,765,166 8/1988 Bergman et al. .
4,833,903 5/1989 de Smet .
4,951,491 8/1990 Lorenz .
5,007,265 4/1991 Mahoney et al. .

OTHER PUBLICATIONS

Chaney, Dale "Water Expansion: A soft Touch for Hard Parts," *Appliance Manufacturer,* Aug. 1980.

Lay, Oliver P. "Some Recent Developments in the Hydroforming Process," Sheet Metal Industries, Sep. 1971, pp. 659–672.

Amino, "Fluid Former, Special Hydraulic Press for Drawing Using Hydraulic Counter Pressure," 5 pages (date unknown).

Amino, "1. Fluid Forming Press (Counter Pressure) Fluid Forming Press," 21 pages (date unknown).

Amino, "Specifications [Flexible Tube Forming Press]," 6 pages, (date unknown).

APPARATUS AND METHOD FOR HYDROFORMING SHEET METAL

REFERENCE TO RELATED APPLICATION

This application is a continuation-in-part of Applicant's pending U.S. patent Application Ser. No. 07/443,112, filed Nov. 29, 1989, now U.S. Pat. No. 5,157,969.

FIELD OF THE INVENTION

The present invention relates to the field of sheet metal forming, and in particular to an apparatus and method for hydroforming sheet metal into parts such as automobile fenders, doors, hoods and the like.

BACKGROUND OF THE INVENTION

In the high-production cookware, appliance and automotive industries, as well as the low- and medium-production aircraft, aerospace, and job-shop industries, metallic sheet may be formed by a variety of different dies, the type and size of the die being dictated by the shape and intended use of the particular part. One process which is used to form a wide variety of these parts is the conventional drawing process. In a draw die, the blank is drawn across a binder surface allowing metal to flow from the bind surface and onto the part. Unfortunately, variable and non-uniform stresses are thereby developed throughout the part which results in localized stretching. This creates severe springback and shape retention problems which makes it nearly impossible to predict, especially with large parts, the amount of springback that will occur. The common practice to overcome this springback or shape retention problem is to overcrown (deform beyond the desired shape) the part. Finding the appropriate degree of overcrown requires a number of costly trial and error procedures. There is also a significant amount of material waste in the drawing process because the blank is oversized to compensate for the metal flowing across the binder surface and to account for varying part strength resulting from non-uniform work hardening.

In my U.S. Pat. No. 4,576,030, I describe a process wherein sheet metal can be one hundred percent stretch formed between co-acting male and female die halves. This is accomplished by providing a pair of opposed gripper steels, at least one of which is provided with a number of spaced apart beads adapted to bite into the sheet metal, around the periphery thereof, when the gripper steels are closed. This permits the sheet metal to be homogeneously, one hundred percent stretch formed, thus resulting in a higher quality of shape retention, a reduction in the number of shock lines and stretch lines, less waste, and increased overall part strength.

Another procedure which enhances the quality of the formed part is that of fluid forming, that is, applying pressurized fluid against one side of the blank in the forming process. The benefits include increased versatility, a better finish on the final part, and reduced tool maintenance costs.

While all these advancements have continued to improve the quality of the part and to stretch the limits of product design, the dies and the supporting machinery and hardware have become larger, more diverse and more expensive. Furthermore, the competitive market dictates a continuous stream of operationally improved and aesthetically novel products. Each new product requires new parts which require new dies, supporting machines and hardware to produce them. Aside from the obvious economic strains associated with repeated design and testing of a new product, the time it takes to transform a part from concept to reality, often measured in years, has a discouraging effect on potential innovation.

What is desired is a sheet forming apparatus that combines the favorable aspects of fluid forming with the advantages of one hundred percent stretch forming; that permits a more accurate approximation of the desired part, reducing if not eliminating the prototype and testing procedure; that can be retooled more easily and more cheaply than existing assemblies; and that is adaptable for operation in conventional, standard sized presses.

SUMMARY OF THE INVENTION

Generally speaking the present invention is a self-contained, stretch hydroform die apparatus which is adapted to operate within a standard double action press and which is adapted to form a variety of different parts from metal sheet.

A standard double action press, including a base and first and second vertically reciprocating slides, is provided with a basic die, which includes an upper shoe mounted to the outer slide, a combination lower shoe and fluid reservoir mounted atop the base, and hydraulic cylinder assemblies connected to the lower shoe. Each of the two cylinder assemblies includes an upwardly extending piston rod which is engaged and depressed by each downward stroke of the inner slide of the press. Specific tooling is provided for the particular part to be formed and includes mating upper and lower dies which are mounted in vertical alignment to the corresponding upper and lower shoes. The upper die defines a downwardly facing part print cavity and the lower die has an upwardly extending bind surface. Sheet metal as a blank or coil fed, is positioned upon the lower die and held thereat by blank locators, is wrapped around the bind surface of the lower die as the first slide, and thereby the upper die, is moved down to a closed position, the blank being clamped between the upper and lower dies whereby the periphery of the blank is securely gripped by an aligned pair of gripper steels mounted in the upper and lower dies. The outer slide then dwells while the inner slide moves down, engaging and actuating upwardly extending rods of the cylinder assemblies, causing hydraulic fluid to be forced through passageways in the lower shoe and lower die and into a region between the clamped blank and the lower die, the blank being 100% stretch formed into the part print cavity of the upper die.

At the end of the forming operation, both inner and outer slides are raised, the piston rods of the cylinder assemblies being raised by their own internal gas springs. As the outer slide moves upward, lifting the upper die therewith, the pressurized fluid trapped between the formed part and the lower die spills out all around the outer die and is channeled into upwardly opening cavities in the combination lower shoe and fluid reservoir, the reservoir being the sump for the hydraulic cylinder assemblies. The apparatus is thus self-contained and fluid recirculating.

When it is desired to form a different part with the apparatus of the present invention, the specific tooling, that is, the upper and lower dies, are replaced with the desired specific tooling having the particular bind surface shape and part print cavity. The remainder of the apparatus remains in place and is intended to be used for many years with different specific tooling to form a variety of different sheet metal parts.

In another embodiment of the present invention, the combination lower shoe and fluid reservoir and the lower die are replaced by a fluid reservoir pan mounted atop the press base and a lower die which sits within the pan. The lower die defines passageways for providing fluid communication between the hydraulic cylinder assemblies and the upper surface of the lower die. Each hydraulic cylinder assembly includes a pair of separate hydraulic cylinder units and a pair of vertically stacked gas springs between each pair of hydraulic cylinder units. The pair of cylinder units and the gas springs are mounted to reciprocate vertically as a unit by a common head block adapted for cooperation with the inner slide of the press.

It is an object of the present invention to provide an improved apparatus for forming sheet metal.

It is another object of the present invention to provide an apparatus for forming sheet metal which affords greater versatility in forming a variety of different parts where the cost and time for retooling are minimized.

It is a further object of the present invention to provide an apparatus for hydroforming sheet metal which is substantially self-contained.

Further objects and advantages of the present invention will become apparent from the following description of the preferred embodiment.

DESCRIPTION OF THE PREFERRED EMBODIMENT

Figure 1:
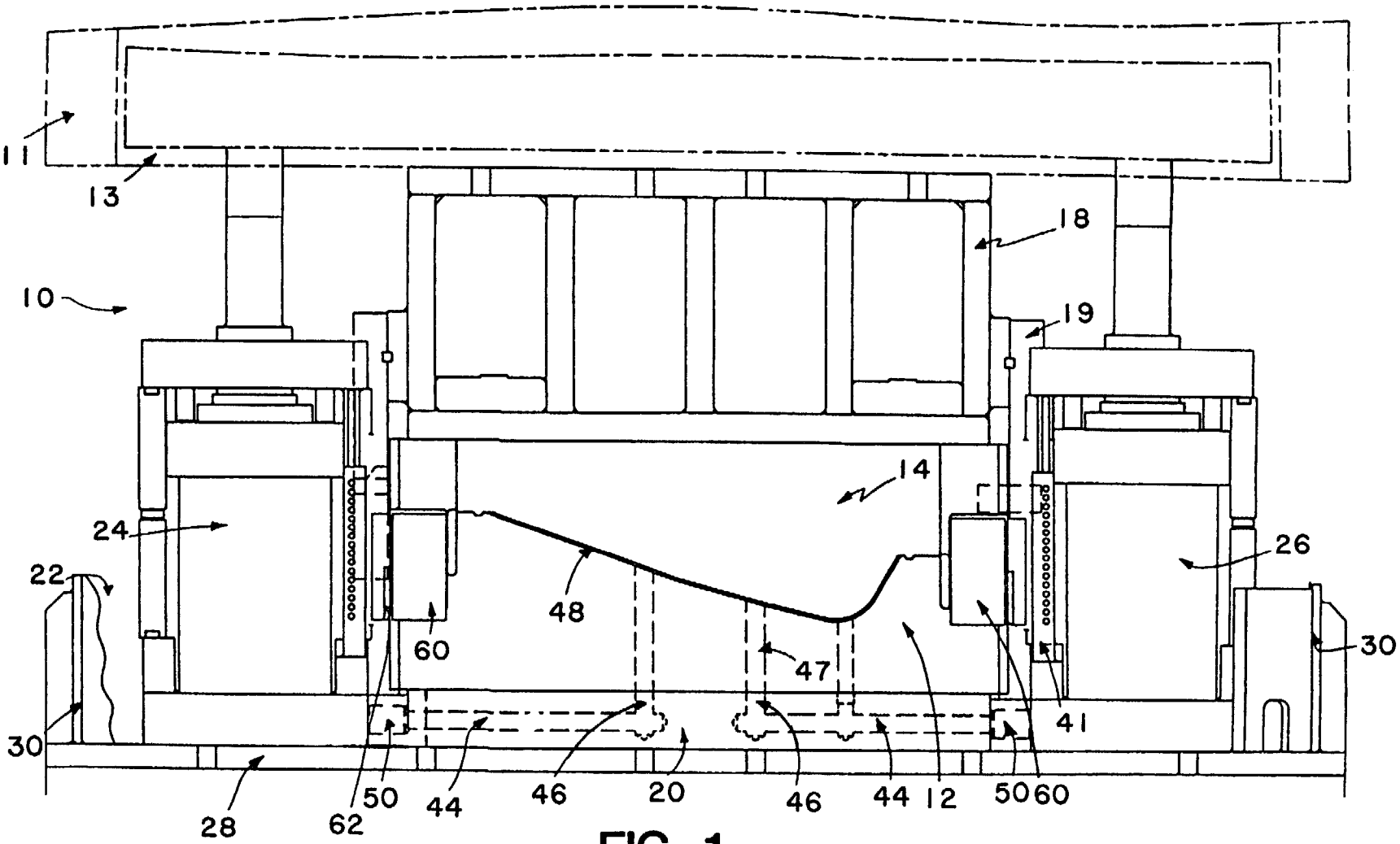
FIG. 1 is a side elevational view, partially in section, of the apparatus for hydroforming sheet metal in accordance with the preferred embodiment of the present invention, and adapted for operation with a conventional double-action press.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
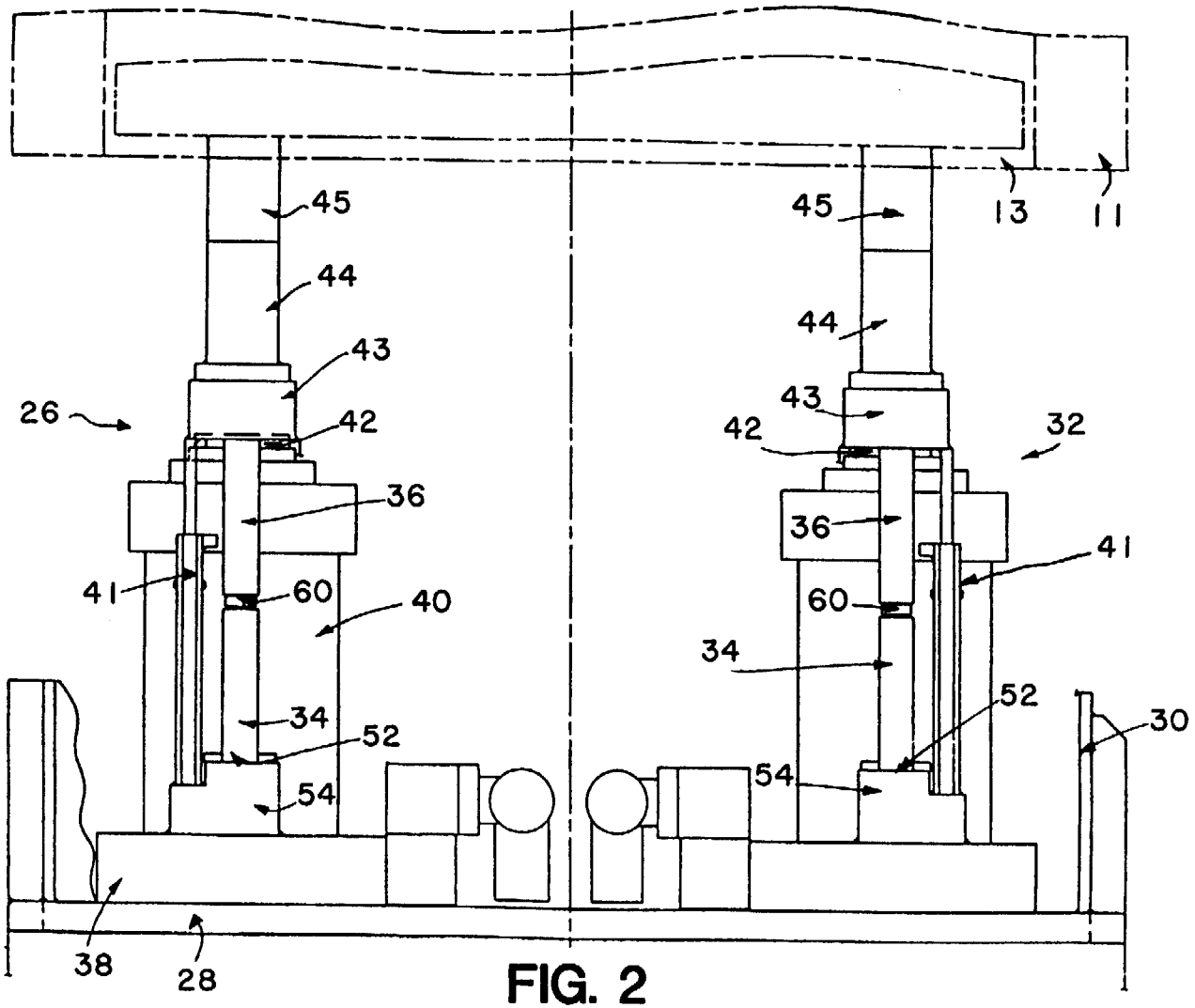
FIG. 2 is a front elevational view, partially in section, of the apparatus for hydroforming sheet metal of FIG. 1.
Figure 3:
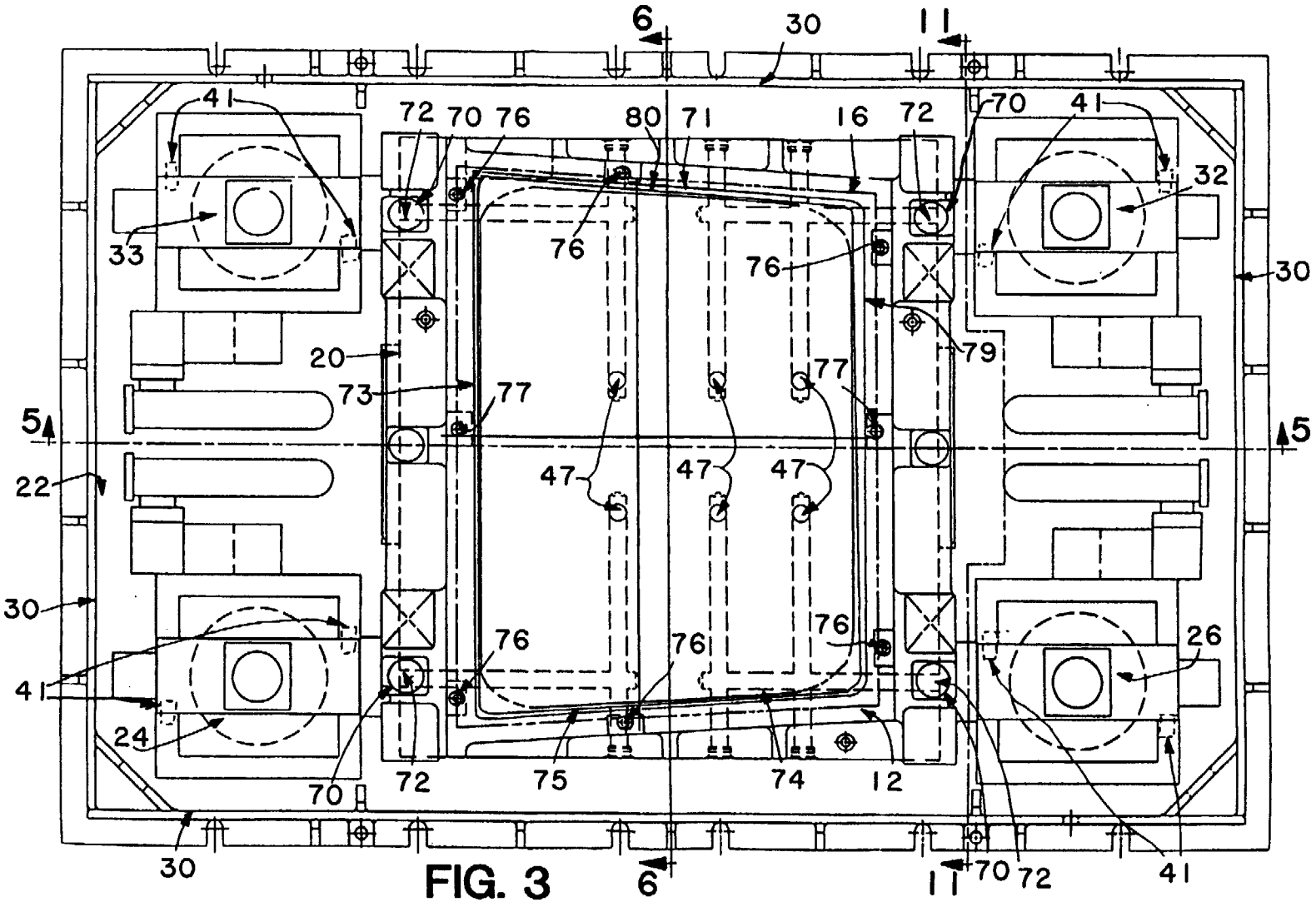
FIG. 3 is a plan view of the lower half of the apparatus for hydroforming sheet metal of FIG. 1 and including the lower shoe 16, hydraulic cylinder assemblies 17 and 18 and lower die 25.

Referring to FIGS. 1, 2 and 3, there is shown an apparatus 10 for hydroforming metal sheet in accordance with the preferred embodiment of the present invention. Apparatus 10 is adapted to operate in and with a conventional double action press. Such presses generally include an outer slide 11 (commonly called an outer blank holder) which has a rectangular tube shape and is mounted for vertical reciprocal movement. A similarly shaped inner slide 12 is likewise mounted for vertical reciprocal movement, telescopically within outer slide 12. Slides 11 and 12 are moved up and down independently by separate linkages thereabove (not shown).

Apparatus 10 of the present embodiment comprises a "basic die" and "specific tooling." The basic die comprises a portion of the user's "capital equipment." That is, the basic die includes those elements of the apparatus which are intended to be used for a very long time to make a variety of different parts. The specific tooling, on the other hand, comprises the interchangeable attachments which actually form the part. The specific tooling is made up of components which are mounted within and operated by the basic die and are changed each time a different part is to be formed.

"Blank" as used refers to a portion of sheet metal which is positioned between upper and lower dies 51 and 25 and is to be formed in accordance with present invention. The blank may be a single piece of sheet metal (80 in FIGS. 1 and 3) or it may be portion of coil of sheet metal as in a progressive die.

Basic Die

The basic die is secured to a standard double action press and generally includes upper shoe 15, lower shoe and fluid reservoir 16, and hydraulic cylinder assemblies 17 and 18. Upper shoe 15 is fixedly mounted to outer slide 11 to move as a unit therewith. Upper shoe 15 is narrow enough to vertically reciprocate between cylinder assemblies 17 and 18 (FIG. 2) and is long enough to enable mating connection to the opposing end walls 14 of outer slide 11 (FIG. 1). Lower shoe 16 sits upon a sub-plate 19 which is clamped to the base or bolster of the press. Lower shoe 16 defines a bed 24 and a number of upwardly opening cavities 20 which surround bed 24. Bed 24 is adapted for receiving thereatop the lower die 25 of the specific tooling. All of the cavities 20 are interconnected by various channels 21 and internal passageways to provide complete fluid communication among the cavities. Cavities 20 thus act as a single fluid reservoir or sump for cylinder assemblies 17 and 18. Appropriate drain ports (not shown) are provided to service the fluid held in cavities 20. The fluid used in the present embodiment is 95% water. The remaining 5% consists of additives to prevent rust and corrosion and to aid in lubrication. This fluid is commercially available and is called high water-based fluid.

Referring to FIGS. 1–4, hydraulic cylinder assemblies 17 and 18 are identical and the following description of cylinder assembly 18 will apply equally to both assemblies 17 and 18. Cylinder assembly 18 generally includes lower head 26, cylinder 27, tubular piston rod 28 and extension 29. Assembly 18 rests atop sub-plate 19 and is firmly bolted to lower shoe 16 through the ears 32 of lower head 26. A filter assembly 30 is connected to and is in fluid communication with lower head 26. A supply/return hose 31 leads from filter assembly 30 up, over and down into adjacent cavity 20. Upon the downstroke of piston 38, pressurized fluid is directed out of cylinder 27, through outlet port **33*a*, through connecting horizontal passageway 34 and vertical passageway 35, both defined in lower shoe 16, and to opening 36 in bed 24. When lower die 25 is properly positioned atop bed 24, a vertical passageway 57 in upper die 25 is aligned for communicating engagement with opening 36 to direct pressurized fluid out through upper surface 62 of die 25. An appropriate fluid control valve (not shown) in port 33*a* governs the fluid flow between cylinder 27 and passageway 34. Cylinder 27 is also in communication with cavities 20 via supply/return port 33*b*, filter assembly 30 and supply/return hose 31. Appropriate fluid control valves (not shown) in port 33*b* govern fluid flow between cylinder 27 and cavities 20**.

Figure 4:
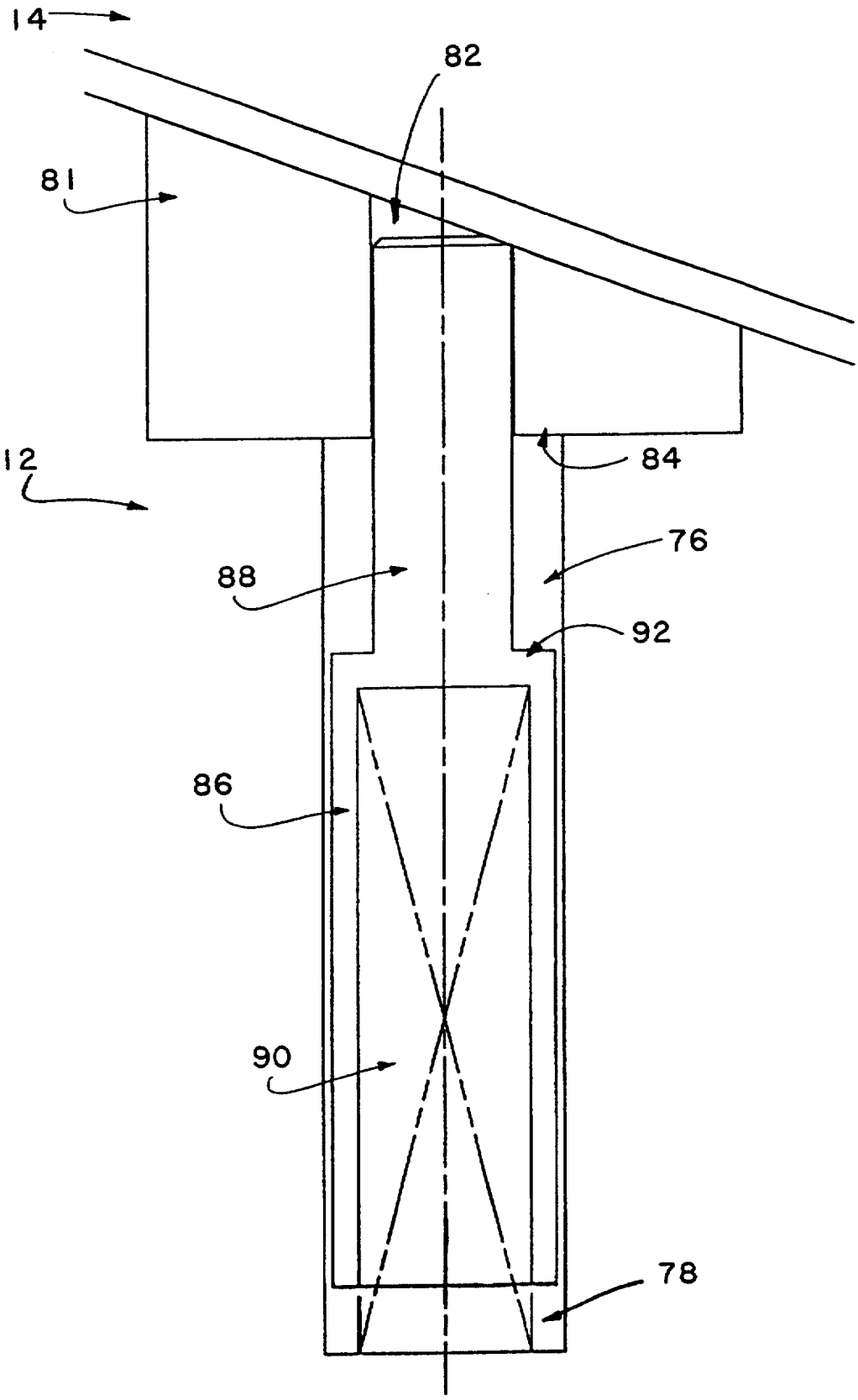
FIG. 4 is a side view, partially in section, of one of the hydraulic cylinder assemblies of the apparatus of FIG. 1.

Referring to FIG. 4, cylinder assembly 18 of the present embodiment is adapted for a 12-inch stroke, 5.875 gallon capacity, although these parameters will vary with the size and capacity of the overall apparatus 10. Tubular piston rod 28 is rigidly connected at its lower end to piston 38 and extends upwardly from cylinder 27, through a hole **37*a* in cap 37. A passageway 37*b* in cap 37 is in communication at one end with hole 37*a* and at its other end with fluid line 37*c*. Line 37*c* is in communication with outlet port 33*a*, thus providing a small amount of fluid lubrication between rod 28 and hole 37*a*. A pair of gas springs 39 and 40 are serially arranged to keep piston 38 biased in the upward position. The seals of gas springs 39 and 40 are designed to prevent the escape of fluid therefrom; they are generally not designed to prevent the inward seepage of high pressure, external fluid. Springs 39 and 40 are therefore isolated from the high pressure fluid developed within cylinder 27 by mounting and sealing them within hollow piston rod 28. A bushing 41 is tightly and rigidly mounted inside the end of rod 28. A pin 42 rests on the bottom of cylinder 27 and extends upwardly through bushing 41 and into hollow piston rod 28. Springs 39 and 40 and a bronze spacer 44 are serially and coaxially stacked between pin 42 and cap 43 of piston rod 28, cap 43 being tightly secured to the top of rod 28. Spacer 44, telescopically slidable within rod 28, defines a pair of opposing recesses 45 which receive and hold the ends of springs 39 and 40 in axial alignment. The sizing of springs 39 and 40, spacer 44, and pin 42 is such that these components will stay slightly compressed when piston 38 is at its upper limit. Springs 39 and 40 are commercially available gas springs and each have a six-inch stroke. An appropriate seal 46 between bushing 41 and pin 42, along with rod 28, cap 43, bushing 41 and pin 42, create a sealed chamber which isolates springs 39 and 40 from the high pressure fluid within cylinder 27, while piston 38, rod 28 and bushing 41 reciprocate vertically and telescopically along pin 42**.

Extension 29 extends upwardly from atop cap 43. Extension 29 is secured to cap 43 by a screw 47 which is accessible through a central passageway 48. As shown in FIGS. 1 and 2, assemblies 17 and 18, and particularly their extensions 29, are aligned with the corresponding, opposing side walls 49 of inner slide 12. When inner slide 12 rams down, side walls 49 contact and depress extensions 29 which activates cylinder assemblies 17 and 18. When the valving in lower head 26 is appropriately switched, activation of assemblies 17 and 18 by the downward movement of inner slide 12 will force fluid from cylinder 27, through passageways 34 and 35, and up through corresponding passageways 57, as described below.

Specific Tooling

The basic die is the holder and input transformer of the present invention while the specific tooling comprises the interchangeable attachments to form the desired part. In the present embodiment, the specific tooling comprises lower wrap die 25 and upper die 51. Lower die 25 rests atop bed 24 and is located in a desired horizontal alignment thereon by appropriate cross-keys 52. Upper die 51 is secured to the bottom of upper shoe 15 in a conventional manner and, like lower die 25, upper die 51 is appropriately cross-keyed in several places (50) to shoe 15. Dies 51 and 25 are thereby assured to be in perfect horizontal alignment each time outer slide 11 and upper shoe 15 ram down, bringing upper die 51 down upon lower die 25. A pair of heel blocks 53 are secured at each corner of upper die 51 to aid and assure perfect alignment upon closing of die 51 upon die 25. Each heel block 53 is provided with a bronze wear plate 54 at its lower, interiorly facing portion, the wear plates coming in contact with and heeling along the outer side surface of lower die 25.

Each of the four corners of lower die 25 defines a recess 55 (FIGS. 1 and 3). A stop block 56 is positioned within each recess 55. Each stop block 56 is sized and mounted so as to prevent upper steels 75 and lower steels 61 from making contact by an amount approximately equal to one-half the metal thickness of the blank to be formed. Thus, when upper die 51 is rammed down with a blank positioned between dies 25 and 51, stop blocks 56 will not contact the corresponding, downwardly facing surface of upper die 51. But, if die 51 is rammed down and there is no blank positioned between dies 51 and 25, the downwardly facing surface of upper die 51 will contact stop blocks 56, precluding dies 51 and 25 from contacting, and more importantly, precluding the beads 133, 134 and 135 of gripper steels 75 (FIG. 10) from contacting backup steels 61.

Lower die 25 defines a pair of vertically extending passageways 57 which are aligned and in communication with openings 36 when lower die 25 is properly aligned via cross-keys 52 atop bed 24. Passageways 57 open upwardly through upper bind surface 62 of lower die 25. As shown in FIG. 3, lower die 25 further includes a pair of long radius blank locators 65, an opposing pair of short radius blank locators 66, a pair of opposing, spring loaded side lifters 67, and a spring-loaded end locator 68.

Figure 5:
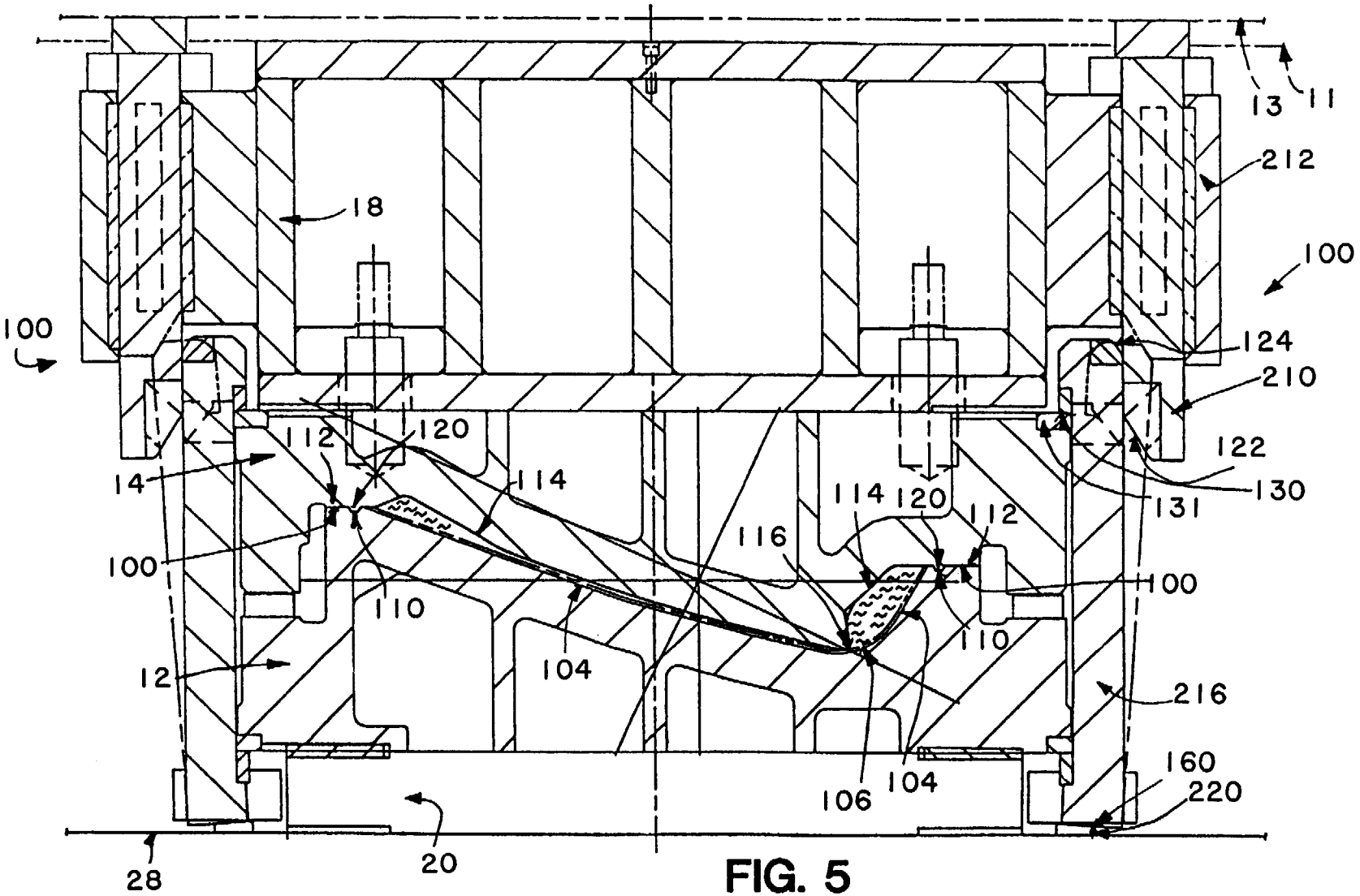
FIG. 5 is a cross-sectional view of the upper and lower dies 51 and 25 of the apparatus of FIG. 2, taken along the line 5—5 and viewed in the direction of the arrows of FIG. 3, and showing the upper and lower dies in the closed position.
Figure 6:
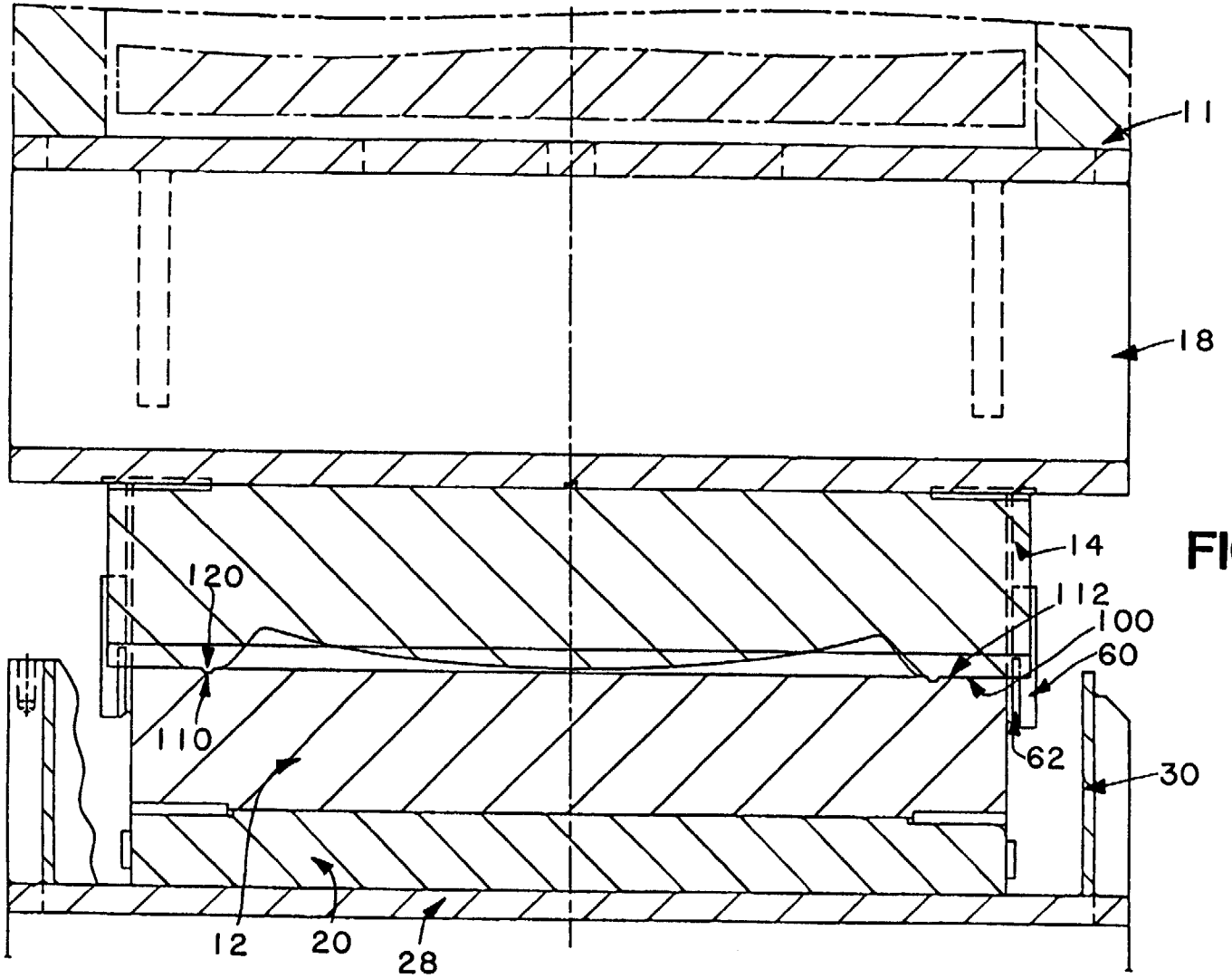
FIG. 6 is a cross-sectional view of the upper and lower dies 51 and 25 of the apparatus of FIG. 2 taken along the lines 6—6 and viewed in the direction of the arrows in FIG. 3, and showing the upper and lower dies in the closed position.

Referring now to FIGS. 3, 5 and 6, the cross-section of bind surface 62 in planes perpendicular to longitudinal centerline 70, all along line 70, is substantially constant. This cross-section of bind surface 62, shown in FIGS. 2 and 5, includes outer, horizontally planar surfaces 63 on the outsides of centrally inclining, planar surfaces 64 which meet at peak ridge 82. Backup steels 61 are secured to lower die 25 within correspondingly-shaped grooves 72, and are arranged in plan view (FIG. 3) in the shape of a rectangle, which shape corresponds to the plan view shape of the finally formed sheet metal part. Steels 61 surround and define a mold cavity lower surface 73.

Upper die 51 has a downwardly-facing, die mating surface 74 (FIGS. 2 and 5) which mates with bind surface 62. A number of gripper steels 75 are arranged secured to upper die 51 within complementary-shaped grooves 76. Gripper steels 75 and backup steels 61 are vertically aligned and have mutually facing surfaces that serve to clamp the sheet metal blank therebetween in a manner fully described in my U.S. Pat. No. 4,576,030, which is hereby incorporated by reference. Defined into upper die 51 and within surrounding gripper steels 75 is a recess or cavity 78 which defines the desired part print.

To load a sheet metal blank into apparatus 10, upper die 51 and heel blocks 53 are in the raised, open position, roughly two to four feet above lower die 25. This enables a sheet metal blank 80 to be slid horizontally from the front (from the left in FIGS. 1 and 6) onto lower die 25. Blank 80 is guided to and held in the loaded position (shown in phantom in FIGS. 3 and 5) by long and short radius blank locators 65 and 66, respectively. Long radius locators 65 are each comprised of an elongate, circular cross-sectioned rod with an upper portion milled away to form an arcuate guide surface 81. When locators 65 are mounted to lower die 25, their guide surfaces are substantially everywhere perpendicularly equidistant from peak ridge 82. Circular bores 83 in lower die 25 and aligned, arcuate cutouts 84 in backup steels 61 define complementary-shaped cavities for snugly receiving the lower portion of each long radius locator 65. Locators 65 are each held firmly in position by a locator keeper 85 which is positioned in aligned notches 86 and 87 of die 25 and locator 65, respectively. Keeper 85 is then secured to die 25 by an appropriate screw 88. A circular bore 91 in upper die 51 and a corresponding arcuate cutout 92 in gripper steel 75 together define an upwardly extending cavity into which extends the upper portion of the corresponding long radius locator 65 when upper die 51 closes onto lower die 25.

Figure 7:
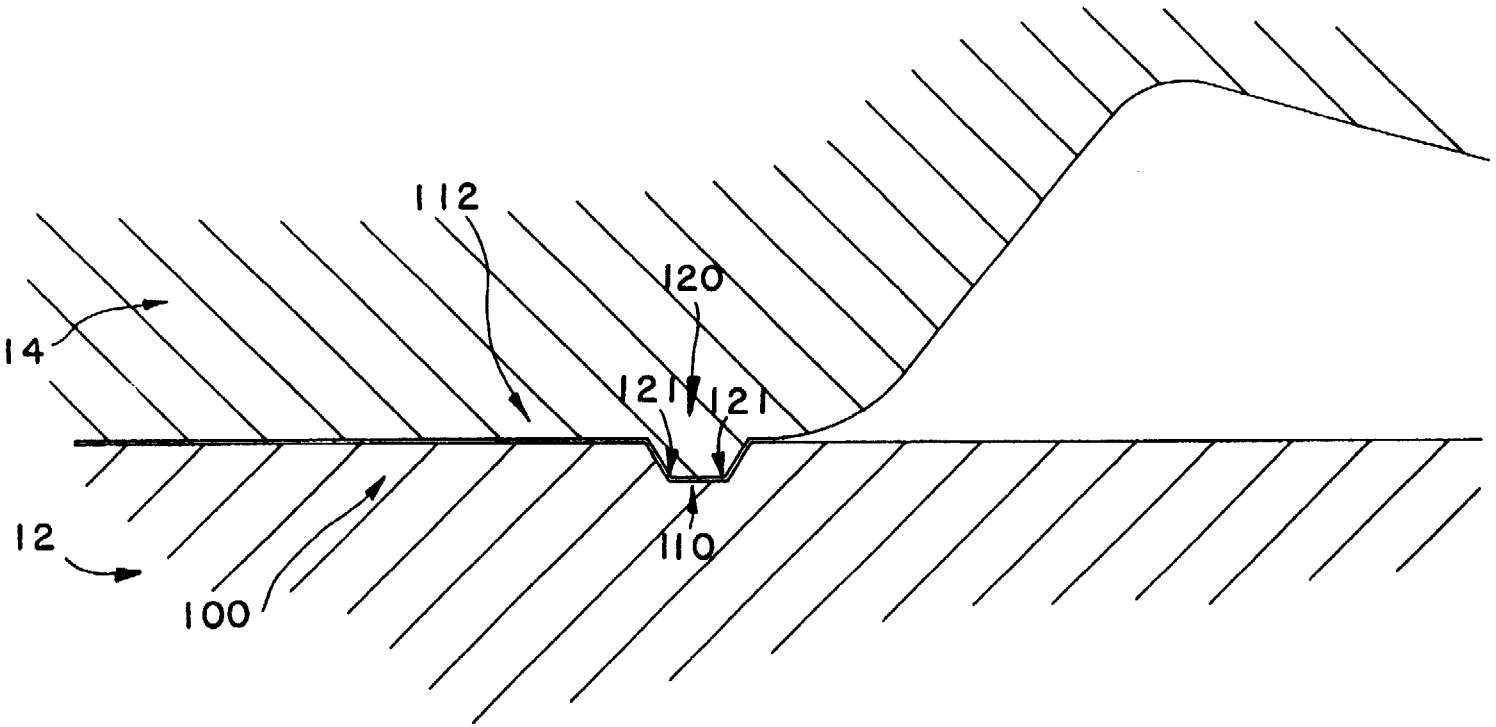
FIG. 7 is a perspective view of one of the short radius blank locators 66.

Referring to FIGS. 5 and 7, the two short radius locators 66 are each comprised of an elongate circular cross-sectioned rod which, like each long radius locator 65, is mounted at its lower portion in a complementary-shaped bore in lower die 25 and held thereat by a locator keeper 93. A portion of the upper section of locator 66 is milled away, forming a planar, inwardly facing guide surface 94. Locater 66 also defines a downwardly extending, central slot 95 which is milled perpendicular to surface 94. A toggle or drop leaf 96 is pivotally mounted within slot 95 by a pin 97 which extends through locator 66. Leaf 96 has a slanted nose portion 98, a hold-down surface 99, and a stop surface 101. As shown in FIG. 5, leaf 96 is at rest and in a locking position whereby stop surface 101 is in contact with the bottom 102 of slot 95, thus precluding clockwise rotation of leaf 96 from that position. Rotation of leaf 96 counterclockwise from the position shown in FIG. 5 is possible by exerting a downward force against that portion of nose 98 which extends outwardly from guide surface 94. Such a force would be exerted by lowering the right-hand edge 103 of blank 80 down against nose 98 which would rotate leaf 96 counterclockwise about pin 97 and allow edge 103 to descend past nose 98. When edge 103 clears nose 98 and hold-down surface 99, leaf 96 will rotate clockwise back to its locking position because the center of mass of leaf 96 is located to the right of pin 97 as shown in FIG. 5. Once edge 103 of blank 80 is thus located below hold-down surface 99 of leaf 96, edge 103 is precluded from rising and blank 80 is precluded from rotating counterclockwise about ridge 82.

Figure 8:
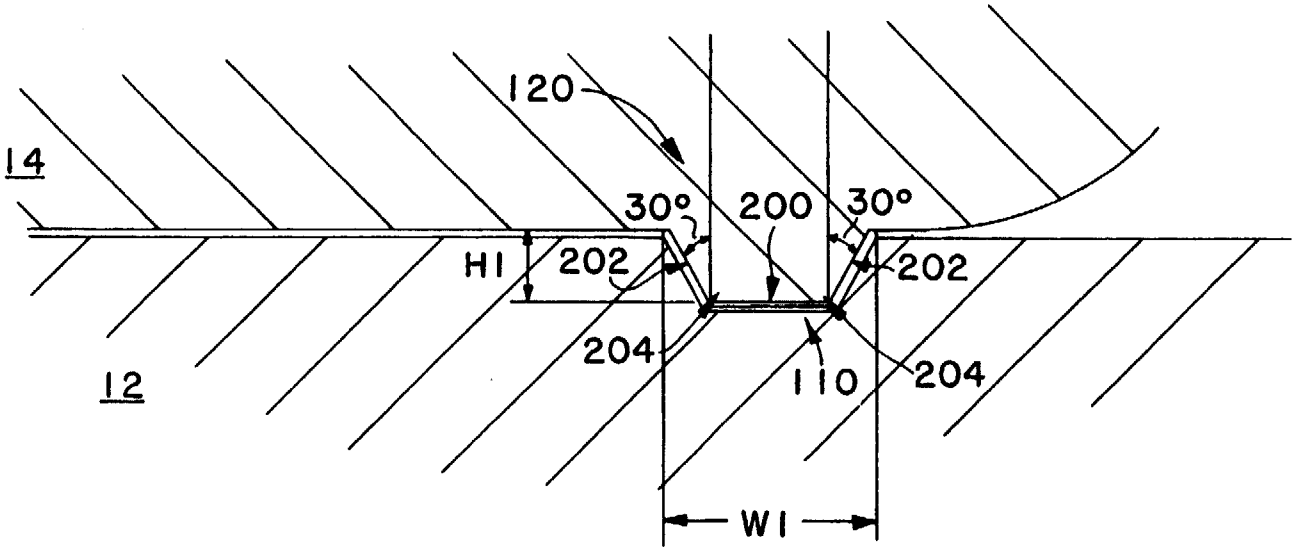
FIG. 8 is a fragmentary section view, enlarged from FIG. 6, showing end locator 68.

Referring to FIGS. 3, 6 and 8, lower die 25 defines at its back end a vertically extending bore 106 which slidably receives vertically reciprocating end locator 68. End locator 68 generally comprises an elongate, circular cross-sectioned rod with an upper portion milled away to form a planar, blank engaging surface 110 and a ledge 112. Bore 106 is located in die 25 directly below a backup steel 61 and below peak ridge 82. A notch 111 is milled into backup steel 61 and defines a planar guide surface 113. Notch 111 is aligned with bore 106 and guide surface 113 is adapted for sliding engagement with surface 110 of locator 68. With backup steel 61 not mounted in its corresponding groove 72, a coil spring 114 is first dropped into bore 106 followed by locator 68. Backup steel 61 is then secured in its groove 72 with notch 111 aligned with bore 106 and with surface 113 adjacent surface 110. Locator 68 may be depressed into bore 106 against the bias of spring 114. Locator 68 may travel upwardly within bore 106 with surface 110 sliding along guide surface 113, until ledge 112 meets the bottom at 115 of backup steel 61. This is the upper limit of travel of locator 68, at which point the top 116 of locator 68 extends roughly 1.25 inches above peak ridge 82. In operation, when upper die 51 is raised above lower die 25, locator 68 is in its extended position as shown in FIG. 1. When upper die 51 closes upon lower die 25, gripper steel 75 contacts top 116 of locator 68 and simply pushes locator 68 down into its storage position in bore 106. From its storage position to its fully extended position, locator 106 has a stroke S1 of approximately 1.25 inches.

Figure 9:
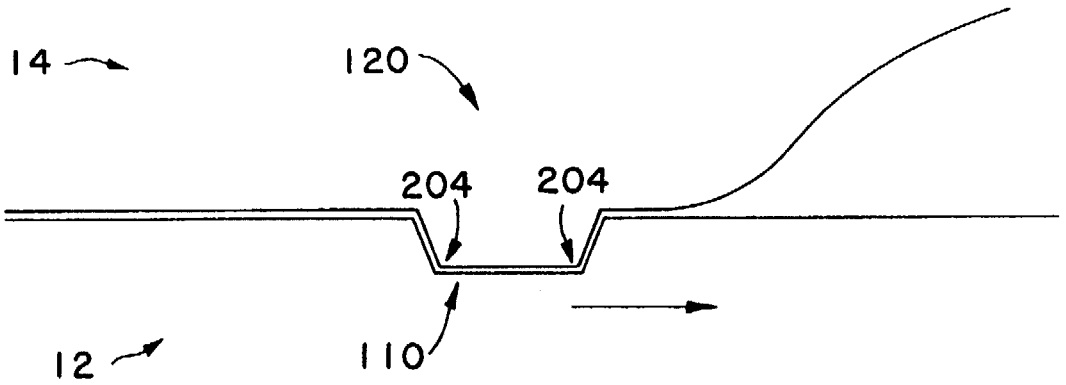
FIG. 9 is a fragmentary section view of one of the side lifters 67 of the apparatus of FIG. 3, taken along the line 9—9 and viewed in the direction of the arrows.

Referring to FIGS. 3, 6 and 9, lower die 25 defines, for each side lifter 67 a vertically extending bore 119 for slidably receiving a vertically reciprocating lifter 67, the bores being located approximately two-thirds of the way toward the rear of lower die 25. The diameter of the lower portion 120 of lifter 67 is approximately equal to the diameter of bore 119 and is greater than the diameter of the upper portion 121 of lifter 67, thereby creating annular stop ledge 122. The corresponding backup steel 61 defines an arcuate cutout 123 which is vertically aligned with bore 119 and which has a radius of curvature approximately equal to the radius of upper portion 121 of lifter 67. A spring 124 is disposed between lifter 67 and the bottom 125 of bore 119 to constantly urge lifter 67 upward. Bore 119 and cutout 123 are defined in lower die 25 and backup steel 61 such that, once gripped between steels 61 and 75 as described below, blank 80 will overlap a portion 127 of the top 126 of lifter 67 as shown in FIG. 9. The stroke S2 of side lifter 67 is defined between the storage position shown in FIG. 9 when top 126 is even with outer, horizontally planar surface 63 and the extended position (not shown) when upper die 51 is raised from lower die 25, and lifter 67 is urged upwardly by spring 124 until ledge 122 contacts the bottom 128 of backup steel 61.

Figure 10:
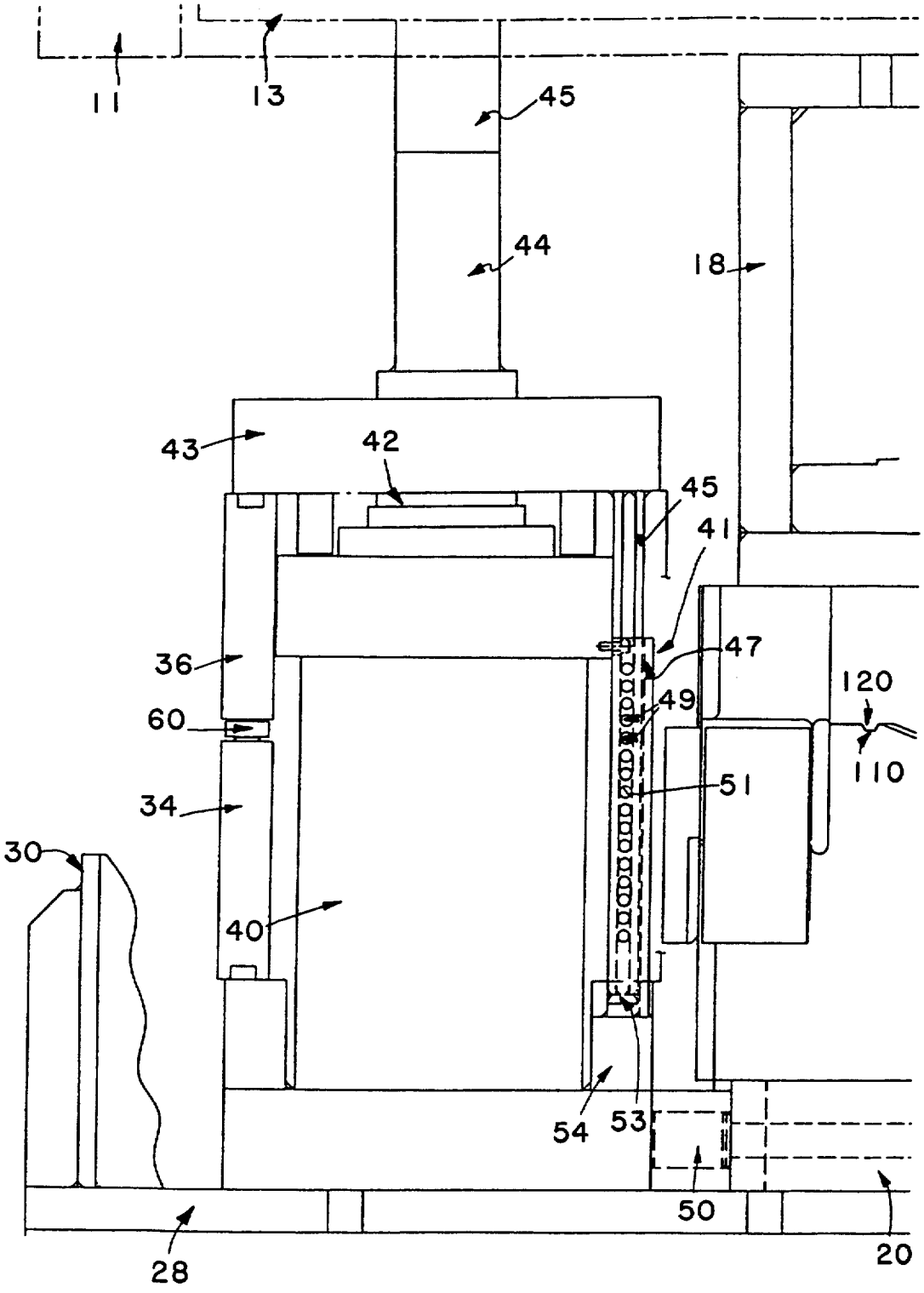
FIG. 10 is an enlarged, fragmentary section view of the gripper and backup steels 75 and 61 of the apparatus of FIG. 2.

As shown in FIG. 10, three similarly-shaped, parallel and elongate protrusions or beads 133, 134 and 135 are provided on gripper steel 75 and extend vertically downwardly therefrom.

Beads 133, 134 and 135 are shaped and formed so as to allow them to pierce or bite into the sheet metal of blank 80 in such manner that some metal will be forced or coined into the space between the beads, thus increasing the thickness of the metal in the area between the beads. When this occurs, nearly the entire force exerted by steels 61 and 75 is concentrated into the area between the beads, with the result that blank 80 may be held without slippage while the part is being stretch formed.

Figure 11:
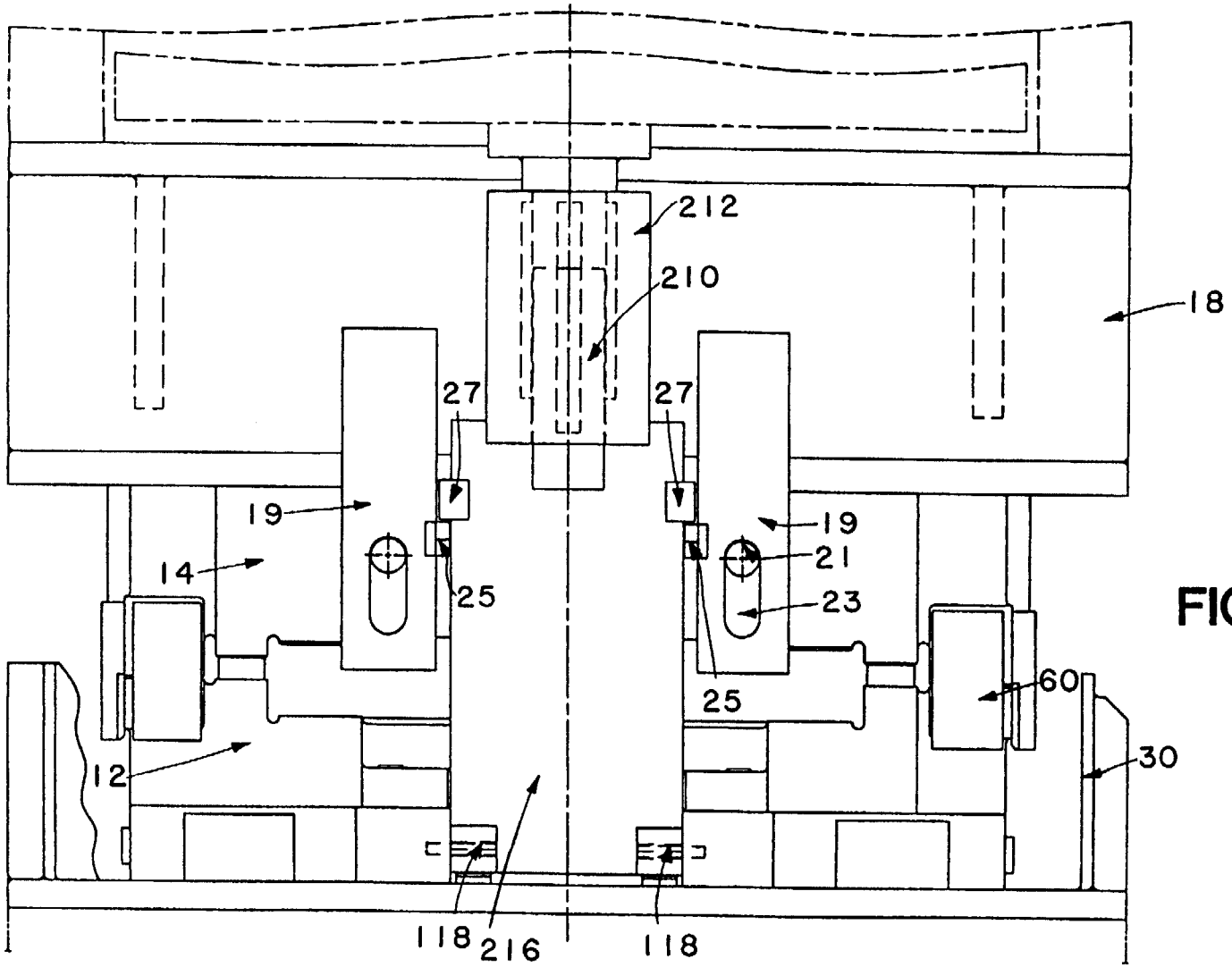
FIG. 11 is a fragmentary section view, enlarged from FIG. 10, showing certain features of the construction of the gripper beads.

FIG. 11 shows the construction of two adjacent beads 134 and 135 in more detail. Each of the beads has a generally rectangular shaped cross-section and defines a pair of relatively sharp edge surfaces which provide the biting action as the sheet metal is clamped between steels 61 and 75. While it should be understood that the size, shape and spacing of the beads may vary somewhat depending upon such factors as the size of the die and the materials used to form the beads and the sheet metal blank, the following dimensional requirements are significant. The beads preferably have a height E which is approximately one-fourth the thickness B of the sheet metal blank 80 and a width C which is approximately one to two times the height of the bead. The beads are spaced apart along their entire lengths at distance D which is approximately 0.1875 to 0.375 inches. Also, the height E of the beads between adjacent beads is less than the height A outside of the inner and outer beads 133 and 135, respectively, by two to three percent. In the preferred embodiment, height E is 0.002 inches less than height A. I have discovered that this difference in the height of the surface 138 between adjacent beads significantly enhances the ability of the beads to grip the sheet metal blank. This causes an increased localized impact or compression of the material trapped between the beads.

In the embodiment shown, the apparatus 10 for forming sheet metal members is adapted for stretch hydroforming a conventional style automobile door from a 0.030 inch thick sheet metal blank 80. Gripper steels 75 and their beads are formed of AISI D2 tool steel having a hardness of RC 60–62, a height A of 0.0077 inches, a height E of 0.0075 inches, a width C of 0.010 inches, and are spaced apart a distance D of 0.250 inches. Also, the base portion of each of the beads are rounded off to a radius R of between approximately E and E/2. Backup steels 61 are formed of AISI D2 tool steel having a hardness of RC 58–60.

As shown in FIG. 3, backup steels 61 completely surround and define mold cavity lower surface 73. Gripper steels 75, aligned directly above backup steels 61, completely surround the part print cavity 78, the outline of which is indicated at 136. With a blank 80 clamped tightly between upper die 51 and its gripper steels 75 and lower die 25 and its backup steels 61, a substantially sealed cavity is created by blank 80 and mold cavity lower surface 73 of lower die 25, the cavity being bounded by backup steels 61.

The operation of apparatus 10 may be described as follows:

In the open position shown in FIG. 1, inner slide 12 is in the up position, away from extension 29, and extension 29 is in the up position by virtue of internal gas springs 39 and 40. Also, outer slide 11, shoe 15 and upper die 51 are all in the up position, several feet above and away from lower die 25 (upper die 51 being farther above lower die 25 than shown in FIG. 1). A rectangular, sheet metal blank 80 is positioned on top of lower die 25, specifically, resting on ridge 82, between locators 65 and 66, and maneuvered thereat until the right-hand edge 103 (FIG. 5) is positioned below hold-down surface 99 of leaf 96. With upper die 51 positioned away from lower die 25, end locator 68 and side lifters 67 extend upwardly from their cavities by virtue of their respective springs. Blank 80 is positioned toward the rear of lower die 25 until the leading edge 139 of blank 80 contacts the flat surface 110 of end locator 68. Side lifters 67, though now fully, upwardly extended, do not extend high enough beyond outer, horizontally planar surfaces 63 to contact the bottom of originally flat blank 80. The position of blank 80, now appropriately loaded atop lower die 25, is shown in FIG. 1 and in phantom in FIGS. 3 and 5.

With blank 80 now properly loaded, outer slide 11 moves down which brings upper die 51 toward and against blank 80 and lower die 25. The lower side 140 (FIG. 2) of upper die 51 first contacts blank 80. Because the opposite side of blank 80 is precluded from rising via hold-down surface 99 of leaf 96, blank 80 is caused to wrap around lower die 25 at ridge 82. Outer slide 11 and thus upper die 51 continue downward, contacting and wrapping the remainder of blank 80 around die 25 until gripper steels 75 and backup steels 61 clamp the periphery of blank 80 therebetween. As die 51 is forced down against lower die 25, beads 133, 134 and 135 pierce into blank 80, displacing an amount of metal into the space between the beads, and tightly gripping blank 80 around its periphery. Finally, outer slide 11 dwells and inner slide 12 moves down, its sidewalls 49 contacting and depressing extensions 29 of cylinder assemblies 17 and 18. Valves in lower head 26 hydraulically connect cylinder 27 with passageway 34 and close off the passage to supply/return line 31. Hydraulic fluid is thereby forced from cylinders 27, through passageways 34, 35 and 57 and into the region between clamped blank 80 and the mold cavity lower surface 73. Blank 80 is clamped sufficiently tightly between gripper steels 70 and backup steels 61, that fluid is substantially prevented from escaping between blank 80 and backup steels 61 and the pressurized fluid stretch-forms blank 80 into the part print cavity 78 of upper die 51. Excess fluid volume is vented through hose 31 into cavities 20 via preset pressure relief valves (not shown) in supply/-return port 33*b*.

The hydraulic pressure required to completely form blank 80 into part print cavity 78 depends upon the properties and thickness of blank 80 and the smallest radius of curvature of the various portions of cavity 78. The required hydraulic pressure will therefore vary each time the specific tooling is changed or the parameters of blank 80 are changed. Pressure relief valves in lower head 26 are therefore adjusted as necessary for each different forming operation.

After completion of the hydroforming operation, inner slide 12 moves up and away from cylinder assemblies 17 and 18. The internal gas springs 39 and 40 of cylinder assemblies 17 and 18 then extend their piston rods 28 to the up position. Valving in lower head 26 blocks off passageways 34 and hydraulically connects cylinders 27 with their supply/return hoses 31. The upstroke of piston rods 28 by gas springs 39 and 40 thus syphons a new charge of fluid from cavities 20 into cylinders 27 for the next hydroform operation.

While inner slide 12 is raised, outer slide 11 is also raised, lifting upper die 51 away from formed blank 80 and lower die 25. Side lifters 67 and end locator 68 pop up by virtue of their corresponding springs. Side lifters 67, being located to the right of lateral centerline 141 (FIG. 3), lift the back or leading end of the now-formed blank 142 (FIG. 5) away from lower die 25 and higher than upwardly extending end locator 68. The formed blank 142 may now be removed from the back of apparatus 10 either manually or with a mechanical device.

Apparatus 10 is provided with automatically recirculating hydraulics. As upper die 51 is lifted away from lower die 25, the hydraulic fluid will spill out all around lower die 25. Splash guards 143 are provided on both sides of lower die 25 to channel the spilling fluid to the ends of shoe 16, back into cavities 20. Upwardly extending, U-shaped shields 144 and 145 are mounted at opposing ends, on top of lower shoes 16 to further contain and guide the spilling fluid into the respective cavities 20.

When it is desired to form a different part with apparatus 10, instead of replacing the entire complement of die components within the press frame as in prior art devices—huge, multi-part components often weighing more than 100,000 pounds—, all that needs to be replaced in the present invention is the specific tooling—die halves 51 and 25. The two dies 51 and 25 of the present invention are comparatively smaller and weigh together about 10,000 pounds. This represents a significant economic and logistic improvement over the prior art.

While the present embodiment is intended to receive a single piece of sheet metal 80 at a time, the invention also contemplates forming sheet metal in a coil fed arrangement (a progressive die). Such an apparatus would provide a cutting device at the back or exit side which would cut off the formed part on the down stroke. Also, the sheet material would be fed in a direction perpendicular to peak ridge 82. Cylinder assemblies would then be positioned at the left and right ends (as apparatus 10 appears in FIG. 1). The shape of lower shoe 16 with its cavities would also be appropriately altered to provide the recirculating fluid operation.

Figure 12:
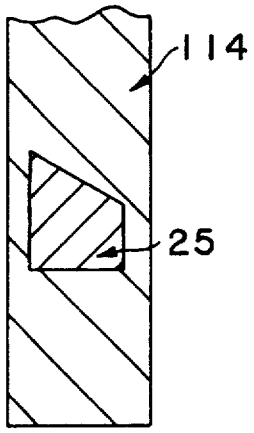
FIG. 12 is a front elevational view, partially in section, of the apparatus for hydroforming sheet metal in accordance with another embodiment of the present invention and adapted for operation with a conventional double-action press.

Referring to FIG. 12, there is shown an apparatus 210 for hydroforming metal sheet in accordance with an alternative embodiment of the present invention.

Basic Die

In the preferred form of apparatus 210, shown in FIG. 12 and described herein, the basic die is still secured to a standard double action press, but here generally includes upper shoe 215, fluid reservoir pan 216, and hydraulic cylinder assemblies 217 and 218. Upper shoe 215 is fixedly mounted to outer slide 211 to vertically reciprocate therewith between cylinder assemblies 217 and 218. Reservoir pan 216 sits upon a sub-plate 219 which is clamped to the base or bolster of the press. Pan 216 defines a central plate 224 which extends outwardly and transitions into upstanding sidewalls 222, thus allowing pan 216 to act as a fluid reservoir or sump for cylinder assemblies 217 and 218. Bed 224 is adapted for receiving thereatop the lower die 225 of the specific tooling.

Figure 13:
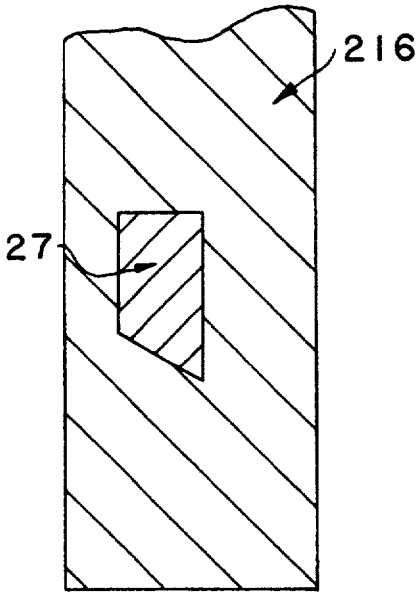
FIG. 13 is a side view, partially in section, of one of the hydraulic cylinder assemblies of the apparatus of FIG. 12.

Referring to FIGS. 13 and 14, hydraulic cylinder assemblies 217 and 218 are identical and the following description of cylinder assembly 218 will apply equally to both assemblies 217 and 218. Cylinder assembly 218 generally includes two hydraulic cylinder units 226 and 227 and a pair of serially arranged gas springs 239 and 240. Cylinder units 226 and 227 each include a lower head 228, a cylinder 229, and a piston rod 230. Both cylinder units 226 and 227 are mounted atop bed 224 and to lower die 225. A filter assembly, fluid return and valve assembly are provided as appropriate within and in connection with lower head 228 to provide operation like that described for cylinder assemblies 17 and 18 of FIGS. 1–4.

Lower die 225 defines in this embodiment horizontal passageways 334 and a connecting vertical passageways 235, the latter of which open to upwardly facing surface 236 of lower die 225. An appropriate conduit 237 extends from lower heads 228 to lower die 225 and provides fluid communication between horizontal passageway 234 and its respective pair of hydraulic cylinder units 226 and 227.

Mounted in between cylinder units 226 and 227 are the pair of vertically stacked gas springs 239 and 240. Lower spring 239 is appropriately fixed at its base 242 to bed 224 via a base block 241 which is mounted to bed 224 and provides conventional means such as set screws for tightly securing spring 239 thereto. The upper end of the piston rod 243 of lower spring 239 and the base 244 of upper spring 240 are likewise fixed together for movement as a unit via a spacer block 245 which is provided with conventional means such as one or more set screws for tightly securing piston rod 243 and base 244 thereto. A common head block 248 spans and rests atop piston rods 230 and piston rod 249 of upper gas spring 240 and is adapted to cooperated with the bottom 247 of inner slide 212. (FIG. 12) Head block 248 and piston rods 230 and 249 are rigidly, mutually connected to move as a unit by appropriate means such as screws 250 extending through passageways 251 in head block 248 and into the top of piston rods 230 and 249. In the present embodiment, only one screw 250 secures piston rod 249 to head block 248 while at least four screws 250 are recommended to connect each piston 230 to head block 248.

In the present embodiment, upper shoe 215 is mounted to bottom 254 of outer slide 211 and is roughly the same as upper shoe 15 of FIG. 2, except that upper shoe 215 has a greater vertical dimension. As shown in FIG. 1, upper shoe 15 spans opposing walls 14 of outer slide 11 and is subjected at its central portion to tremendous upward forces of resistance from lower die 25 as outer slide 11 pushes downward. By providing an increased vertical dimension in upper shoe 215, its strength and resistance to bending is increased, thereby permitting greater forces to be applied through outer slide 211, and thereby permitting larger and more complicated parts to be formed with apparatus 210.

Specific Tooling

Upper die 252 is unchanged from upper die 51 of FIGS. 1 and 2 and is secured to the bottom of upper shoe 215. Lower die 225 is mounted directly atop bed 224 and is located in the desired horizontal alignment thereon by appropriate cross-keys 253. As described above, lower die 225 defines communicating horizontal and vertical passageways 234 and 235 for providing, with conduit 237, fluid communication between lower heads 228, of hydraulic cylinder assemblies 217 and 218, and upwardly facing surface 236 of lower die 225.

In operation, apparatus 210 performs essentially the same as apparatus 10 of FIGS. 1 and 2 with outer slide moving downwardly to clamp a positioned blank (not shown) between upper die 252 and lower die 225. As outer slide 211 dwells, inner slide 212 moves down and forces head blocks 248 and piston rods 230 and 249 down, thereby forcing hydraulic fluid from cylinders 229, through the valving in lower heads 228, through conduits 237, passageways 234 and 235, and into the region between the clamped blank and the mold cavity (not shown) which is defined in the lower surface of 255 of upper die 252. On the upstroke of inner slide 212, gas springs 239 and 240 push head block 248 upward, thereby lifting piston rods 230 upward and resetting hydraulic cylinder units 226 and 227. Fluid released or escaping from between upper and lower dies 252 and 225 falls into fluid reservoir pan 216 and is drawn as needed into lower heads 228 through appropriate valved ports (not shown).

As with the embodiment shown in FIGS. 1 and 2, apparatus 210 of FIG. 12 can be used to form a wide variety of different parts simply by replacing the upper and lower dies 252 and 225 and without making major structual modifications to the entire press.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-contained apparatus for stretch forming, without drawing, sheet metal using fluid to act directly on the sheet metal, said apparatus capable of being used within a double action conventional press having a base and outer and inner vertically reciprocating slides, said apparatus comprising:

a basic die mountable to the press and including an upper shoe mountable to the outer slide and hydraulic means connectable to a lower die, mechanically actuatable by the inner slide and for providing pressurized fluid to specific tooling;

specific tooling including upper and lower dies moveable between open and closed positions, said upper die being replaceably mounted to said upper shoe and having a downwardly facing, die mating surface which defines a part print cavity, and said lower die being replaceably mountable atop the base and having an upwardly facing bind surface aligned below the die mating surface, said upper and lower dies being adapted to receive and clamp a sheet metal blank between the die mating surface and the bind surface, said lower die including first passageway means for transmitting pressurized fluid from said hydraulic means to said bind surface so as to stretch form the sheet metal blank against said die mating surface without drawing said blank wherein said hydraulic means includes at least one hydraulic cylinder assembly having a reciprocating piston rod adapted to be depressed by the downward stroke of the inner slide and said hydraulic means includes a fluid reservoir pan mountable atop the base and adapted to collect fluid spilling from said dies, said reservoir supplying fluid for said at least one cylinder assembly and wherein said lower die sits within said pan.

2. The self-contained apparatus for forming sheet metal of claim 1 wherein there are two hydraulic cylinder assemblies located on opposite sides of said lower shoe.

3. The self-contained apparatus for forming sheet metal of claim 2 wherein each of said two hydraulic cylinder assemblies includes two hydraulic cylinder units and includes spring means opposing downward movement of the inner slide and for lifting piston rods of said cylinder units to a reset position.

4. A self-contained apparatus for hydraulically forming sheet metal, comprising:

a press having a base and outer and inner vertically reciprocating slides;

an upper shoe fixed to said outer slide;

a lower die replaceably mounted atop said base;

an upper die defining a part print cavity and being replaceably mounted to said upper shoe, said upper die having an open position above and lifted away from said lower die by said outer slide and a closed position above and biased toward said lower die by said outer slide, said upper and lower dies adapted to tightly clamp a sheet metal blank therebetween when said upper die is in the closed position; and hydraulic means, mechanically actuatable by said inner slide, for providing pressurized fluid to a region between said lower die and a blank clamped between said upper and lower dies to hydraulically form the blank into the part print cavity wherein said inner slide has reciprocation upward and downward strokes and wherein said hydraulic means includes at least one hydraulic cylinder assembly having a piston rod adapted to cooperate with and driven by said inner slide on at least one of the upward and the downward strokes thereof and wherein there are two cylinder assemblies of said at least one hydraulic cylinder assembly, the two cylinder assemblies being located on opposite sides of said lower die and wherein said lower die defines first passageway means for transmitting pressurized fluid from said two hydraulic cylinder assemblies to said region.

5. The self-contained apparatus for forming sheet metal of claim 4 wherein said hydraulic means further includes a fluid reservoir pan mounted atop said base, and wherein said two cylinder assemblies sit within and are mounted atop said pan, and wherein said lower die sits within said pan between said two cylinder assemblies.

6. The self-contained apparatus for forming sheet metal of claim 5 wherein said fluid reservoir pan is adapted to collect fluid spilling from said dies, said reservoir pan supplying fluid for said two cylinder assemblies.

7. The self-contained apparatus for forming sheet metal of claim 5 wherein each of said two hydraulic cylinder assemblies includes two hydraulic cylinder units and includes spring means for lifting piston rods of said cylinder units to a reset position.

8. The self-contained apparatus for forming sheet metal of claim 7 wherein each cylinder assembly includes a common head block mutually connected to piston rods of the two respective cylinder units and to the respective spring means to vertically reciprocate as a unit therewith and be engaged and depressed by the inner slide.

9. A method for hydraulically forming sheet metal, comprising the steps of:

providing a press having a base, outer and inner vertically reciprocating slides and a basic die, said basic die including a lower shoe mounted atop said base, an upper shoe fixed to said outer slide and hydraulic means, actuatable by said inner slide, for providing pressurized fluid to a die;

providing specific tooling which includes mating upper and lower dies moveable between open and closed positions, said upper die defining a part print cavity and said lower die having an upwardly facing bind surface and first passageway means for transmitting pressurized fluid from said hydraulic means to said bind surface;

replaceably mounting said upper die to said upper shoe;

positioning metal sheet between said upper and lower dies;

actuating said outer slide downwardly whereby said upper die moves downwardly toward said lower die and against the sheet until the sheet is firmly clamped between said upper and lower dies; and hydroforming the sheet by moving said inner slide downwardly whereby said inner slide actuates said hydraulic cylinder assembly and forces fluid into a region between said lower die and the sheet wherein said providing a press step includes said inner slide having reciprocating upward and downward strokes and said hydraulic means including at least one hydraulic cylinder assembly having a piston rod adapted to engage with and be driven by said inner slide on at least one of the upward strokes thereof, and wherein said providing a press step includes said piston rod extending upwardly toward, being aligned below, and being unattached from said inner slide, said inner slide being adapted to depress said piston rod on the downward stroke thereof.

10. The method for forming sheet metal of claim 9 wherein said providing a press step includes said hydraulic means defining a fluid reservoir pan mounted atop said base and adapted to collect fluid spilling from said dies, said reservoir pan supplying for said at least one cylinder assembly.

11. The method for forming sheet metal of claim 10 wherein said providing said press step includes there being two cylinder assemblies of said at least one cylinder assembly, both of which are mounted with said pan.

12. The method for forming sheet metal of claim 11 wherein said providing a press step includes each of said two hydraulic assemblies includes two hydraulic cylinder units and includes spring means for lifting piston rods of said cylinder units to a reset position.

13. The self-contained apparatus for forming sheet metal of claim 12 wherein the providing a press step includes each cylinder assembly including a common head block mutually connected to piston rods of the respective two cylinder units and to the respective spring means to vertically reciprocate as a unit therewith and be engaged and depressed by the inner slide.

* * * * *